United States Patent [19]

Nowicki et al.

[11] Patent Number: 4,759,454

[45] Date of Patent: Jul. 26, 1988

[54] HOLLOW PLASTIC BOTTLE WITH WRAP-AROUND LABEL

[75] Inventors: Casimir W. Nowicki; Long F. Chang, both of Sylvania, Ohio

[73] Assignee: Owens-Illinois Plastic Products Inc., Toledo, Ohio

[21] Appl. No.: 947,143

[22] Filed: Dec. 29, 1986

[51] Int. Cl.[4] ..... B65D 1/02; B65D 1/40; B65D 23/08

[52] U.S. Cl. ..... 215/12.1; 215/1 C; 220/66; 220/70; 40/310

[58] Field of Search ..... 215/1 C, 12 R, 12.1, 215/12.2; 264/509; 220/66, 70; 40/310

[56] References Cited

U.S. PATENT DOCUMENTS

| | | | |
|---|---|---|---|
| 3,801,689 | 4/1974 | Langecker | 264/509 |
| 3,811,588 | 5/1974 | Vermeerbergen et al. | 215/1 C |
| 4,134,510 | 1/1979 | Chang | 220/70 X |
| 4,502,607 | 3/1985 | Szajna | 220/70 |

FOREIGN PATENT DOCUMENTS

| | | | |
|---|---|---|---|
| 2456715 | 8/1976 | Fed. Rep. of Germany | 40/310 |
| 1361504 | 4/1964 | France | 215/1 C |

*Primary Examiner*—William Price
*Assistant Examiner*—Sue A. Weaver

[57] ABSTRACT

A hollow plastic bottle comprising a bottom wall, a side wall about which a label is wrapped and a neck with a finish for receiving a closure. The bottom wall is shaped to withstand drop loads and comprises a central portion, a first annular portion extending outwardly and downwardly from the periphery of the central portion, a second curved portion extending from the periphery of the first annular portion and having a concave inner surface and a convex exterior surface, and a third annular portion extending from periphery of the curved portion upwardly and outwardly to an annular shoulder portion connected to the side wall of the bottle.

8 Claims, 2 Drawing Sheets

HOLLOW PLASTIC BOTTLE WITH WRAP-AROUND LABEL

This invention relates to hollow plastic containers and particularly to hollow plastic containers having labels thereon.

BACKGROUND AND SUMMARY OF THE INVENTION

In the manufacture and use of hollow plastic containers, it is common to apply a label. Typical examples of such containers are one gallon containers for detergent or bleach. It has been found that when a label is applied that extends completely around the side wall of the container, the label stiffens the container such that the container will not withstand drop loads. It has been found that the problem becomes more serious when paper labels with adhesive thereon are applied by in-mold labeling method wherein a paper label is applied to a cavity of a mold, the mold is closed about a hot parison, and the hot parison is blown against the cavity thereby causing the labels to become a part of the side wall of the container. The side wall is stiffened considerably due to the high elastic constant of the paper labels.

Accordingly, among the objectives of the present invention are to provide a hollow plastic container with a wraparound label wherein the container is strengthened to withstand drop loads; wherein the strength is provided without added cost; and wherein the strengthening does not adversely affect the appearance of the container.

In accordance with the invention, a hollow plastic bottle comprising a bottom wall, a side wall about which a label is wrapped and a neck with a finish for receiving a closure. The bottom wall is shaped to withstand drop loads and comprises a central portion, a first annular portion extending outwardly and downwardly from the periphery of the central portion, a second curved portion extending from the periphery of the first annular portion and having a concave inner surface and a convex exterior surface, and a third annular portion extending from the periphery of the curved portion upwardly and outwardly to an annular shoulder portion connected to the side wall of the bottle.

DESCRIPTION

Figure 1:
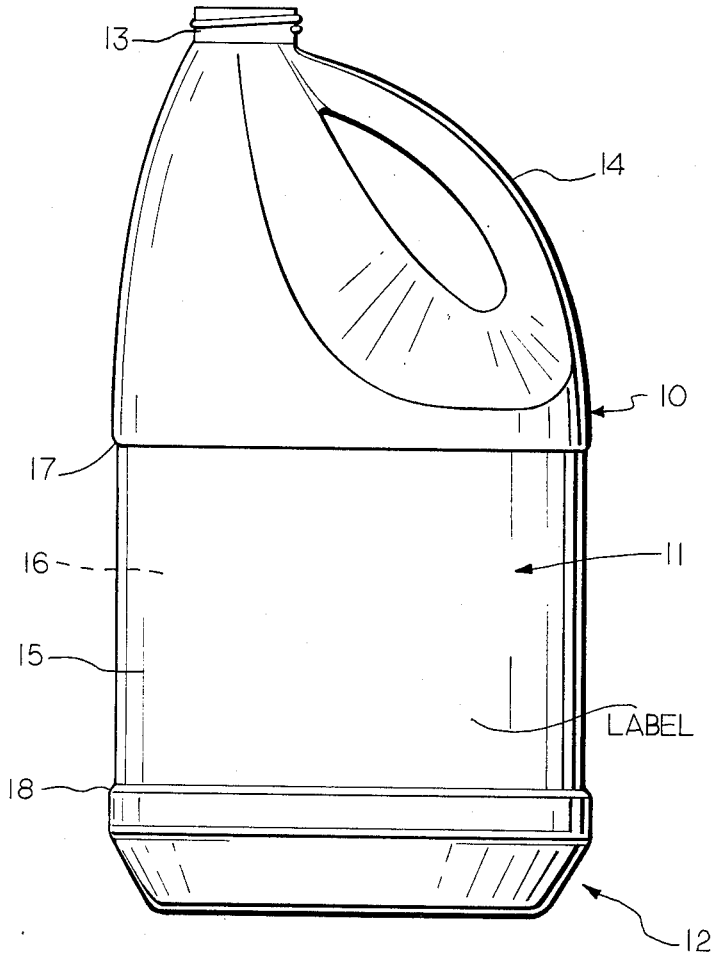
FIG. 1 is an elevational view of a container embodying the invention.
Figure 3:
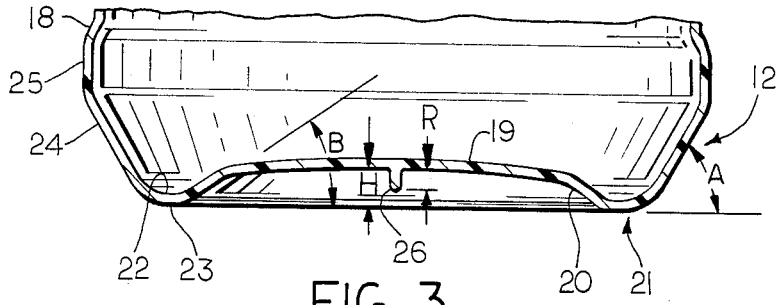
FIG. 3 is a fragmentary sectional view taken along the line 3—3 in FIG. 2.
Figure 4:
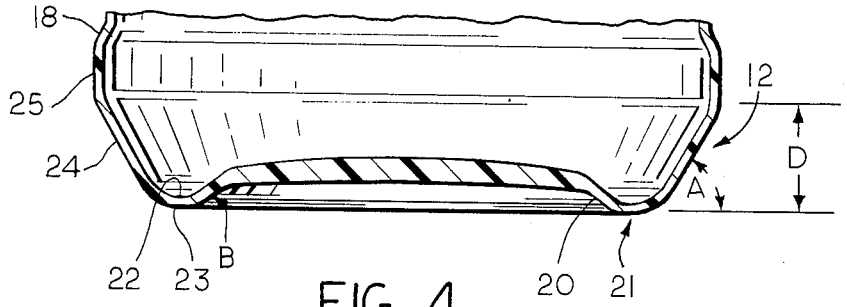
FIG. 4 is a fragmentary sectional view taken along the line 4—4 in FIG. 2.
Figure 2:
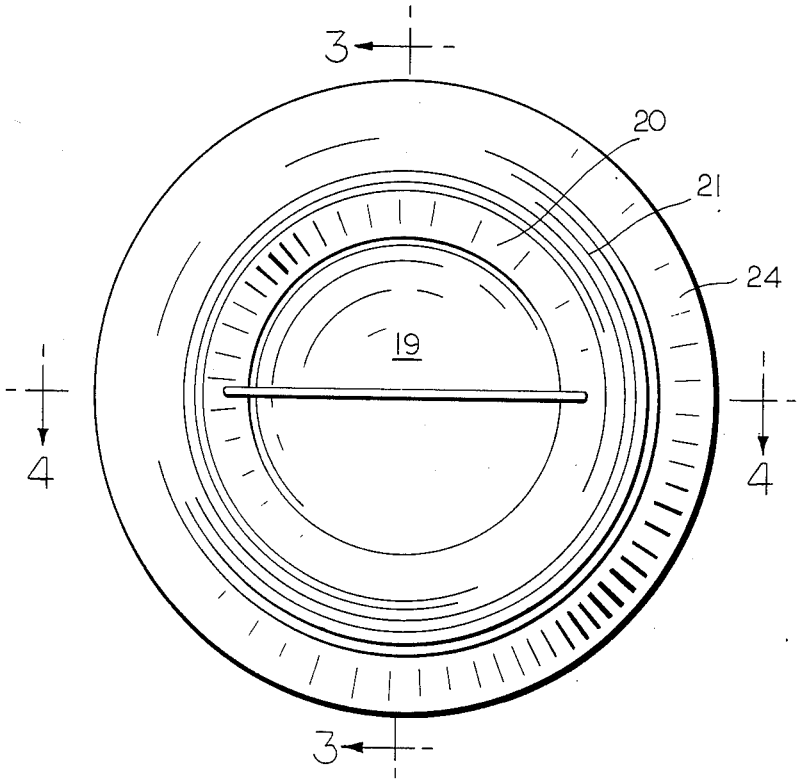
FIG. 2 is a bottom plan view of a container.

Referring to the drawings, the hollow plastic container 10 embodying the invention comprises a side wall 11, a bottom wall 12 and a neck 13 defining a threaded finish for receiving a threaded closure. In the form shown, the container includes a handle 14. The bottle is made by blow molding and may be made of any blow moldable plastic plastic such as the olefins including polyethylene and polypropylene or polyvinyl chloride.

A label 15 is substantially completely wrapped around a cylindrical portion 16 of the side wall. The label may be wrapped completely around or nearly completely around the portion 16.

The label 15 may comprise paper or plastic.

The side wall includes spaced shoulders 17, 18 that define the upper and lower edges of the area to be covered by the label 15.

In accordance with the invention, the bottom wall 12 includes a central portion 19 which is preferably concave upwardly, a first substantially straight annular portion 20 extending from the periphery of the central portion 19 downwardly and outwardly, an annular or curved surface engaging heel portion 21 extending from the lower edge of the annular portion 20 and having a concave upper or inner surface 22 and a convex lower or outer surface 23, and a second annular portion 24 which is substantially straight and extends from the periphery of the curved heel portion 21 outwardly and upwardly to a short annular portion 25 the upper end of which defines the shoulder 18.

The angle A which the annular portion 24 makes with a plane extending perpendicular to the axis of the container and in which the surface engaging surface of heel portion 21 lies is not less than 45° and preferably about 60°. The angle B which the annular portion 20 forms with a perpendicular plane and in which the surface engaging surface of heel portion 21 lies is less than 45° and preferably about 30°.

The axial or vertical height D of the angled portion 24 is preferably about two times the height H of the central portion 19.

A diametral rib 26 preferably extends downwardly from the bottom surface of central portion 19 and preferably has a height R at the center which is about one fourth of the height D.

What is claimed is:

1. A hollow plastic container comprising a bottom wall, a label, a side wall about which said label is wrapped substantially completely around the side wall, a neck with a finish for receiving a closure, said bottom wall comprising a central portion, a first annular portion extending outwardly and downwardly from the periphery of the central portion, a second annular portion having a surface engaging portion extending radially outwardly from the periphery of the first annular portion and having an inner periphery and an outer periphery, a third annular portion extending radially outwardly and upwardly from the periphery of the second surface engaging portion to an annular shoulder portion connected to the side wall of the bottle, said first annular portion forming a first acute angle with the inner periphery of the second annular portion, said third annular portion forming a second acute angle with the outer periphery of the second annular portion, said second acute angle being greater than the first acute angle, said central portion being spaced axially from said surface contacting portion of said second annular portion such that normally there is a space between the central portion and the surface engaged by the container, said central portion including a diametrical rib extending axially outwardly from the central portion, said third annular portion having a vertical height which is greater than the vertical height of the first annular portion.

2. The hollow plastic container set forth in claim 1 wherein said first acute angle is less than 45° and said second acute angle is greater than 45°.

3. The hollow plastic container set forth in claim 1 wherein said first acute angle is about 30° and said second acute angle is about 60°.

4. The hollow plastic container set forth in claim 2 wherein said vertical height of the third annular portion is about two times the height of the central portion above the second annular portion.

5. The hollow plastic container set forth in claim 4 wherein the height of the diametrical rib is about one fourth the height of the third annular portion.

6. The hollow plastic container set forth in any of claims 1–5 wherein said label comprises a paper label.

7. The hollow plastic container set forth in any of claims 1–5 wherein said label comprises a paper label bonded to the side wall by in-mold labeling.

8. The hollow plastic container set forth in any of claims 1–5 wherein said label is bonded to the side wall by in-mold labeling.

* * * * *